US010848857B2

(12) United States Patent
Brandston

(10) Patent No.: US 10,848,857 B2
(45) Date of Patent: Nov. 24, 2020

(54) SPEAKER

(71) Applicant: Oda Inc., New York, NY (US)

(72) Inventor: D. Perry Brandston, New York, NY (US)

(73) Assignee: ODA, INC., New York, NY (US)

( * ) Notice: Subject to any disclaimer, the term of this patent is extended or adjusted under 35 U.S.C. 154(b) by 0 days.

(21) Appl. No.: 16/704,772

(22) Filed: Dec. 5, 2019

(65) Prior Publication Data

US 2020/0228893 A1 Jul. 16, 2020

Related U.S. Application Data

(60) Provisional application No. 62/775,528, filed on Dec. 5, 2018.

(51) Int. Cl.

| | |
|---|---|
| ***H04R 1/28*** | (2006.01) |
| ***H04R 1/02*** | (2006.01) |
| ***H04R 7/04*** | (2006.01) |
| ***H04R 9/06*** | (2006.01) |

(52) U.S. Cl.

CPC ..... *H04R 1/2834* (2013.01); *H04R 1/025* (2013.01); *H04R 7/045* (2013.01); *H04R 9/06* (2013.01); *H04R 2400/11* (2013.01)

(58) Field of Classification Search

CPC ..... H04R 1/2834; H04R 1/025; H04R 7/045; H04R 9/06; H04R 2400/11; H04R 7/04; H04R 7/08; H04R 7/18; H04R 7/20

See application file for complete search history.

(56) References Cited

U.S. PATENT DOCUMENTS

| | | | | |
|---|---|---|---|---|
| 6,278,790 | B1 | 8/2001 | Davis et al. | |
| 6,748,090 | B1 * | 6/2004 | Bachmann | H04R 7/045 181/161 |
| 2001/0026625 | A1 | 10/2001 | Azima et al. | |
| 2006/0159301 | A1 * | 7/2006 | Guenther | H04R 1/2834 381/431 |
| 2007/0064964 | A1 * | 3/2007 | Cheung | H04R 7/04 381/323 |
| 2019/0075392 | A1 * | 3/2019 | Kinoshita | H04R 1/2834 |

FOREIGN PATENT DOCUMENTS

| | | | | |
|---|---|---|---|---|
| GB | 2349034 A | * | 10/2000 | H04R 7/045 |
| GB | 2368484 | | 5/2002 | |

* cited by examiner

*Primary Examiner* — Mark Fischer
(74) *Attorney, Agent, or Firm* — Leason Ellis LLP

(57) ABSTRACT

A speaker includes an outer frame defining a hollow interior space. The speaker includes a distributed mode loudspeaker (DML) member disposed along a front face of the outer frame and an elastic seal that is disposed around a perimeter of the DML member and being disposed between and coupled to the DML member and the outer frame. The elasticity of the elastic seal permits the DML member to move (e.g., vibrate). A passive diaphragm is disposed along a rear face of the outer frame such that an air cavity is formed between the DML member and the passive diaphragm. An electro-acoustic exciter is provided for exciting resonant modes in the DML member. The DML member is thus coupled to the passive diaphragm by air contained within the air cavity resulting in movement of the passive diaphragm due to air movement within the cavity as a result of the excitation of the DML member.

17 Claims, 4 Drawing Sheets

SPEAKER

CROSS-REFERENCE TO RELATED PATENT APPLICATIONS

This application is based on and claims priority to U.S. Provisional Patent Application 62/775,528, filed Dec. 5, 2018, the entire contents of which is incorporated by reference herein as if expressly set forth in its respective entirety herein.

TECHNICAL FIELD

The present invention relates to speaker and more specifically, relate to a distributed mode loudspeaker (DML) that is configured to always remain on and ready to receive a signal.

BACKGROUND

There are many different types of speakers that can be used to listen to music and other audio broadcasts, etc. DML concerns flat panel loudspeaker technology in which the sound is produced by inducing uniformly distributed vibration modes in the panel through an electro-acoustic exciter. The present disclosure describes improvements to such devices.

SUMMARY

The speaker of the present invention generally comprises two main components (elements), namely, (1) a WIFI/Bluetooth connected speaker of unique acoustic properties; and (2) a software platform that supports high-quality live audio streams that are broadcasted to the speaker arrangement (e.g., a pair of speakers).

A speaker includes an outer frame defining a hollow interior space. The speaker includes a distributed mode loudspeaker (DML) member disposed along a front face of the outer frame and an elastic seal that is disposed around a perimeter of the DML member and being disposed between and coupled to the DML member and the outer frame. The elasticity of the elastic seal permits the DML member to move (e.g., vibrate). A passive diaphragm is disposed along a rear face of the outer frame such that an air cavity is formed between the DML member and the passive diaphragm. An electro-acoustic exciter is provided for exciting resonant modes in the DML member. The DML member is thus coupled to the passive diaphragm by air contained within the air cavity resulting in movement of the passive diaphragm due to air movement within the cavity as a result of the excitation of the DML member.

BRIEF DESCRIPTION OF THE DRAWING FIGURES

DETAILED DESCRIPTION OF CERTAIN EMBODIMENTS

Figure 1:
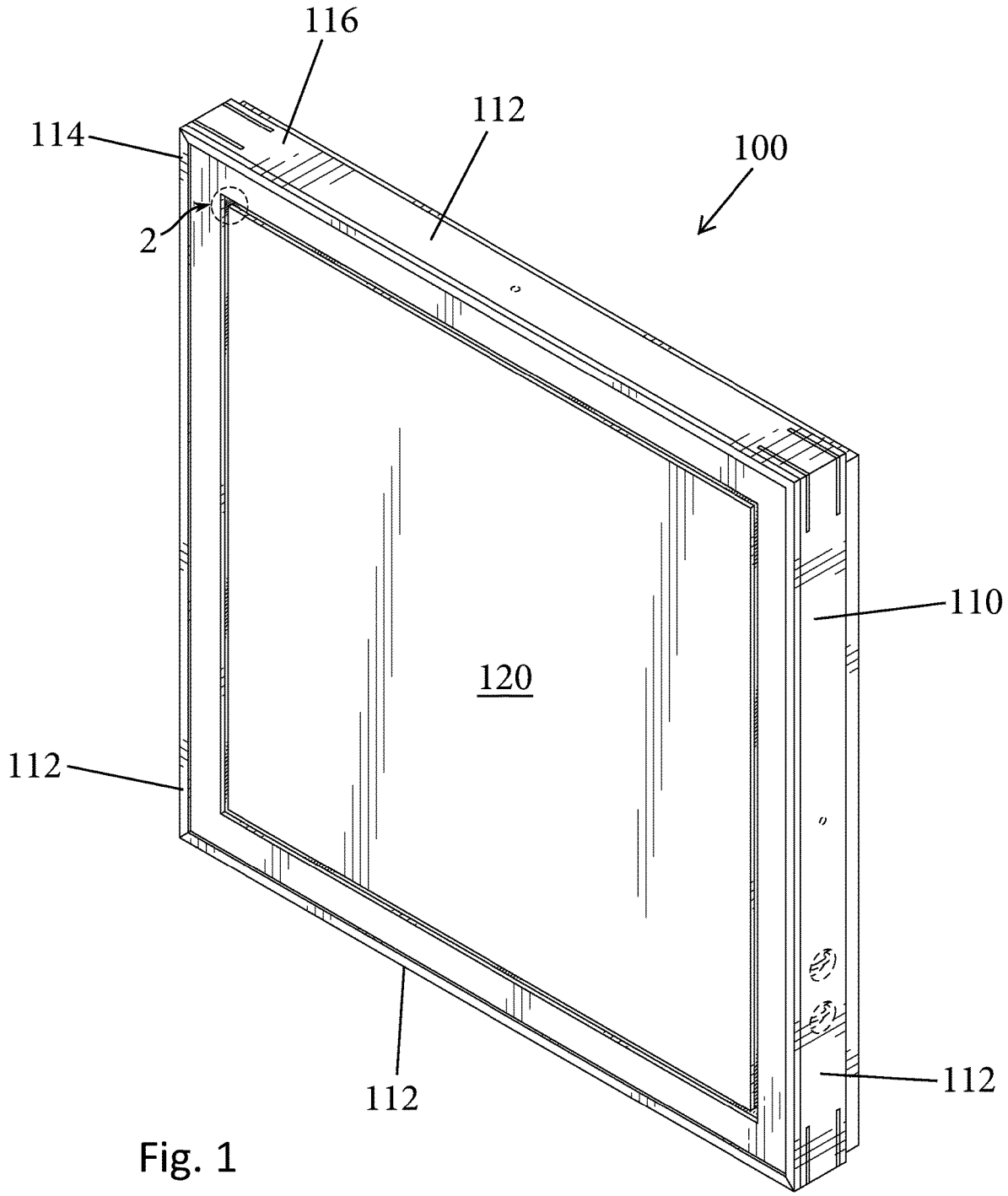
FIG. 1 is a front and side perspective view of a speaker in accordance with the present invention.

The present invention is directed to a speaker that is an extension to the distributed mode loudspeaker (DML). The DML radiates sound from a flat surface by exciting resonant modes in the flat surface such that any frequency has a unique pattern of dispersion. The power response of the DML can be quite uniform throughout the audio range although the measured frequency response varies substantially depending on the location of the measuring microphone.

As discussed herein, DML is thus flat panel loudspeaker technology in which the sound is produced by inducing uniformly distributed vibration modes in the panel through an electro-acoustic exciter. As discussed below, exciters for DMLs include, but are not limited to, moving coil and piezoelectric devices, and are placed to correspond to the natural resonant model of the panel. In one embodiment, the exciter can be an electrodynamic motor.

The speaker of the present invention is configured to extend the response downward in frequency to provide useful bass while incorporating some of the benefits of dipole or bipole loudspeakers in filling more space with sound in a portable package.

A speaker 100 according to one embodiment of the present invention is shown in FIGS. 1-4 and is configured so as to provide an air cavity (e.g., air sealed enclosure) behind an actively driven DML surface 120, and a low Q passive radiating diaphragm on the back of the speaker 100. As known in the art, the quality factor of Q factor is a dimensionless parameter that describes how underdamped or oscillator or resonator is. It is defined as the ratio of the peak energy stored in the resonator in a cycle of oscillation to the energy lost per radian of the cycle. Q factor is alternatively defined as the ratio of a resonator's center frequency to its bandwidth when subject to an oscillating driving force. However, in the present disclosure, it should be understood that there is a virtual infinity of resonant frequencies in the diaphragm versus a single resonant frequency in a conventional passive radiator.

The element 120 is referred to herein as a DML surface, it will be appreciated that as described herein it is formed of a physical structure (e.g. a panel or the like) that is mounted to the outer frame 110. Thus, it can also be referred to as a DML member or DML element.

More specifically, the speaker 100 has an outer frame 110 that is hollow and therefore, internally within the outer frame 110 is a hollow space. The illustrated outer frame 110 has a square or rectangular shape and therefore, is defined by four side walls 112. The side walls 112 are joined at their corners using traditional frame manufacturing techniques. The outer frame 110 has a front face 114 and an opposing rear face 116. The front face 114 and rear face 116 can be planar surfaces.

The outer frame 110 can be formed of any number of different materials so long as the materials serve the intended purpose. For example, the outer frame 110 can be formed of wood, metal, glass reinforced epoxy materials, or plastic; however, other materials are possible.

The speaker 100 has an active DML surface (structure) 120 which can comprise a traditional rigid plate that is suspended within the outer frame 110. In the illustrated embodiment, the DML surface 120 is a rigid wood plate.

The DML surface 120 can have a complementary shape relative to the frame 110 and in the illustrated embodiment, the DML surface 120 has a square shape. The DML surface 120 comprises a suspended element in that it is suspended and "floats" within the hollow interior of the frame 110 in that it is not directly attached to the frame 110 but rather an indirect connection is formed. More particularly, an elastic seal 130 is disposed about the perimeter of the DML surface 120 and serves to suspend the DML surface 120 within the frame 110. The elastic seal 130 is thus a highly compliant rolled surround and can be coupled to the DML surface 120 and outer frame 110 using traditional techniques. For example, an adhesive (e.g., glue) or other bonding techniques or even fasteners can be used to attach the elastic seal 130 to the DML surface 120 and the outer frame 110. For example, the elastic seal 130 can be glued to the outer frame 110 and also to the DML surface 120 so as to result in the DML surface 120 being suspended within the frame 110. The highly compliant nature of the elastic seal 130 allows for movement of the DML surface 120 relative to the outer frame 110 and in particular, the DML surface 120 can move forward and rearward (vibrate) within the frame 110 with the elastic seal providing a restoring force. The elastic seal 130 can thus be a bead or gasket that surrounds the perimeter of the DML surface 120.

The elastic seal 130 can come in any number of different cross-sectional shapes so long as a seal is made between the outer frame 110 and the DML surface 120 that seals the air cavity behind the DML surface 120 but still permits vibration of the DML surface 120.

Figure 2:
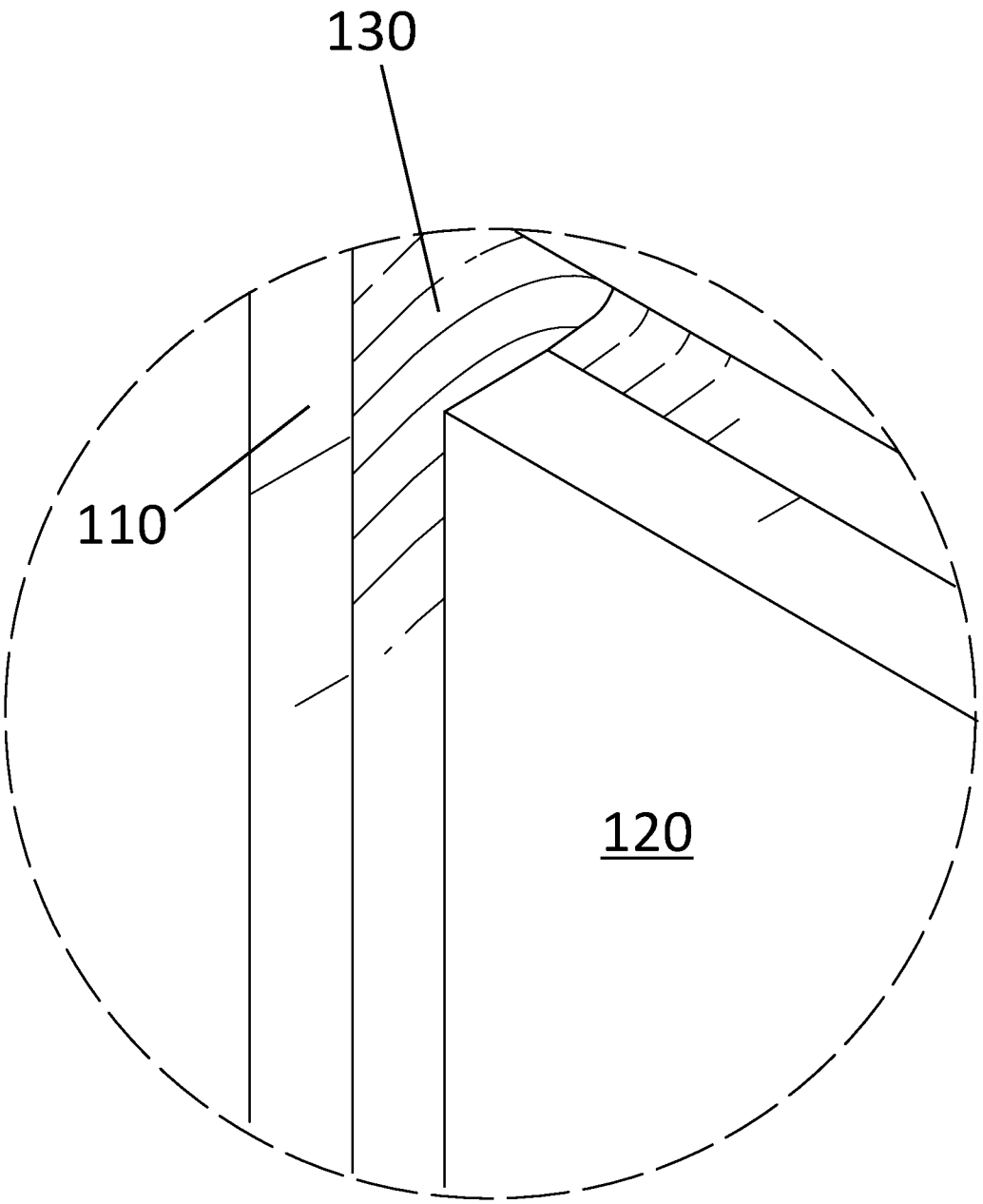
FIG. 2 is a close-up of a corner portion of the speaker.
Figure 3:
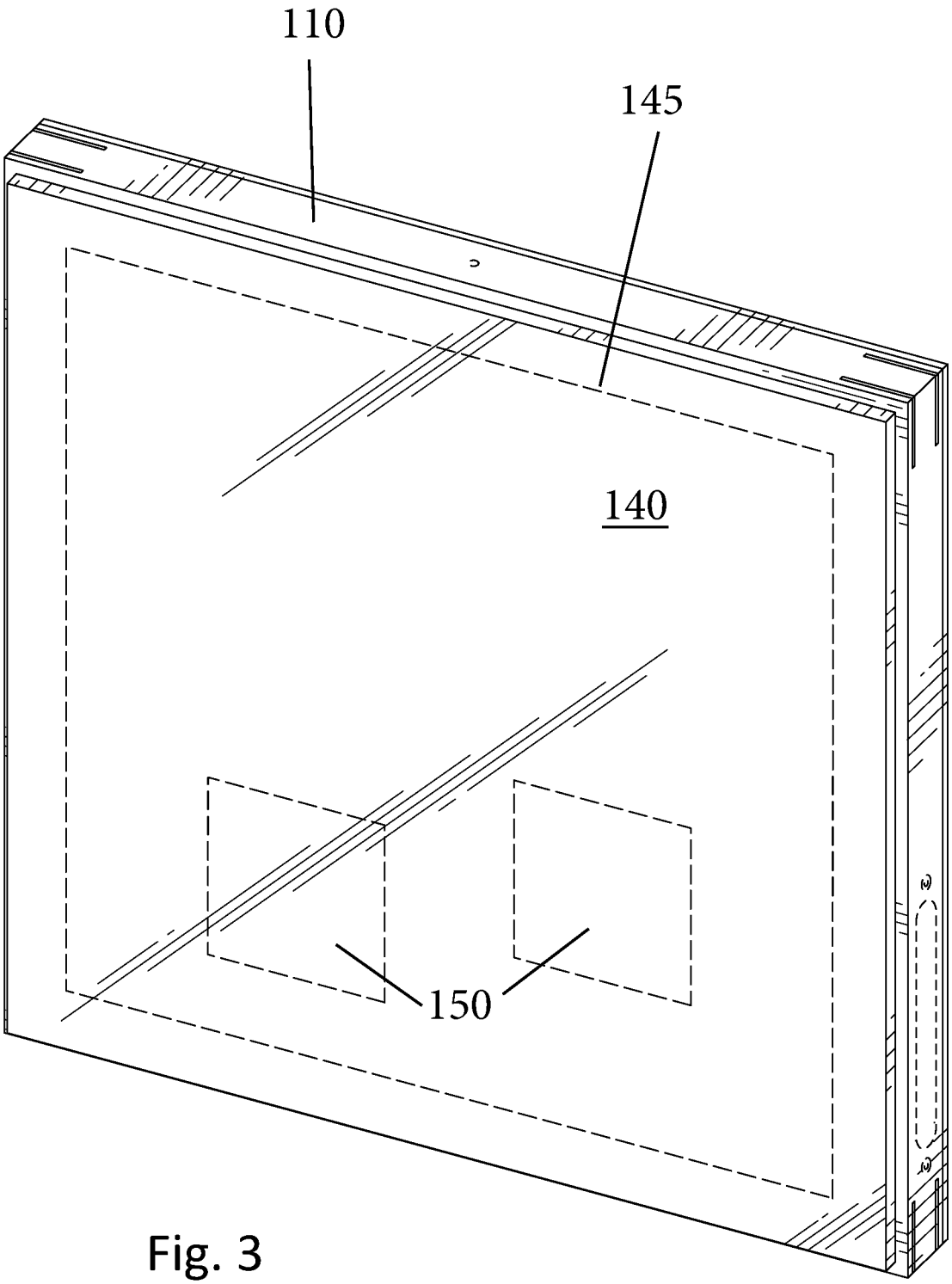
FIG. 3 is a rear perspective view of the speaker.
Figure 4:
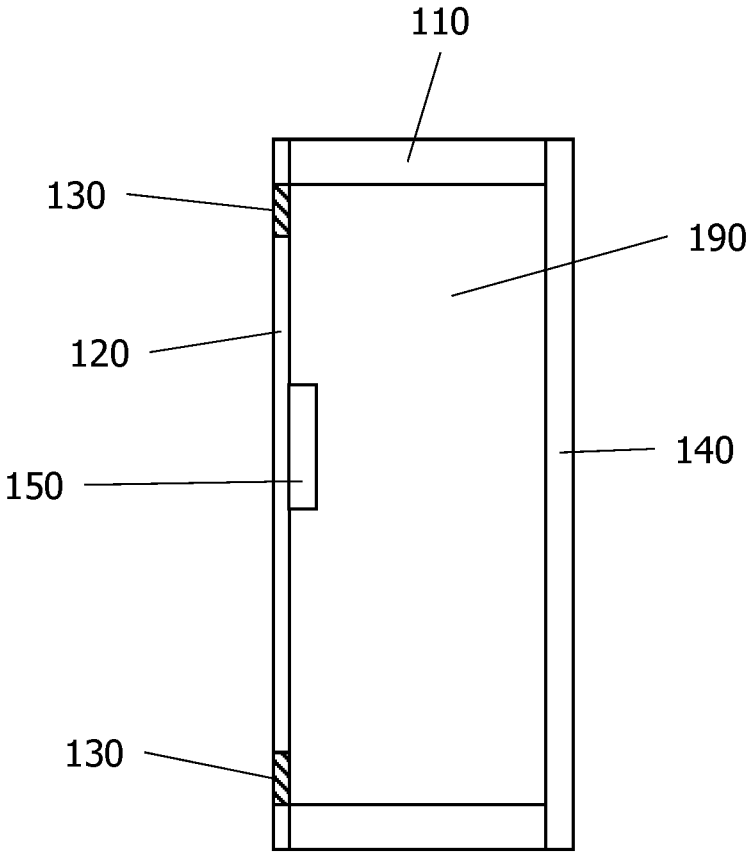
FIG. 4 is a cross-sectional view of the speaker.

FIG. 2 is a close-up of a corner of the speaker 100 generally showing the elastic seal 130 between the DML surface 120 and the outer frame 110.

The elastic seal 130 can be formed of any number of different materials and in particular, can be formed of any number of different polymers, such as molded silicone. In one embodiment, the elastic seal 130 is formed of a compliant silicone material (e.g., siloxane).

The DML surface 120 can be formed of any number of different materials suited for the intended application. For example, the DML surface 120 can be formed of wood, a hard plastic, metal, a composite material (e.g., glass reinforced epoxy), wood, etc.

The DML surface 120 is thus attached to the front face 114 of the outer frame 110 and thus, the DML surface 120 faces forward. The DML surface 120 thus closes off and seals the front of the outer frame 110.

The speaker 100 also includes a passive diaphragm 140 that is coupled to the rear face 116 of the outer frame 110 so as to define an air cavity 190 that is formed within the outer frame 110 between the passive diaphragm 140 and the DML surface 120. As described herein, the air cavity 190 is preferably at least substantially airtight and preferably is an airtight chamber.

The passive diaphragm 140 is preferably an airtight membrane that is stretched onto a diaphragm frame 145. The passive diaphragm 140 is thus an elastic membrane that can be formed of any number of different materials, including but not limited, to certain polymers, such as a polyester fabric that includes an epoxy material. In one embodiment, the passive diaphragm 140 is formed of a resin impregnated fabric. The passive diaphragm 140 can also be formed of other elastic materials such as a treated canvas, nonwoven fabrics, a polyester film, etc. Due to its elastic nature, the passive diaphragm 140 has a range of motion, such as vibration.

In certain aspects, as discussed herein, the passive diaphragm 140 has a "drum head" appearance and characteristics. The passive diaphragm 140 thus defines the rear of the speaker 100. As shown, the passive diaphragm 140 is planar in form and is mounted to the rear of the outer frame 110.

The diaphragm frame 145 can be formed of any number of different rigid materials, including but not limited to wood, metal, plastic, etc. The diaphragm frame 145 can thus have a square shape.

The passive diaphragm 140 thus closes off the rear of the speaker 100 and thus, also closes off the air cavity (chamber) 190.

The modal behavior of the suspended plate (DML surface) 120 is entirely unlike that of the elastic membrane (passive diaphragm) 140. Between this and the small difference in time between the panels, the radiation patterns of the front (active) surface (DML surface 120) and the rear (passive) surface are not correlated in any way. Because of the lack of correlation between the front and rear radiation, typical dipole cancellation is reduced.

As in a traditional DML element, the DML surface 120, at least one electro-acoustic exciter, such as an electro dynamic motor 150 that is coupled to an inner face of the DML surface 120. In one embodiment, there are two or more electro dynamic motors 150 along the inner (rear) surface of the DML (surface) element.

When a plurality of motors are used, each motor 150 can be coupled to the inner (rear) face of the DML surface 120 using any number of traditional techniques, including but not limited, to the use of adhesive (glue), bonding agent, etc. For example, two motors 150 can be coupled to the inner face of the DML surface 120.

The motor 150 can be of an electrodynamic type or a piezoelectric type. Each motor 150 excites bending waves in the DML surface 120, which is designed to be stiff, in order to propagate those waves. When used in a nominally dipole configuration to the largest waves, which correspond to the bass in music can cancel due to the interaction of the front and rear emissions. A narrowing of dispersion that varies with frequency occurs as the wavelengths become comparable to the size of the radiating surface and any surround baffle. The air path between the front and rear is short, when the baffle is small. There is also a potential for diffraction from features on the back of the loudspeaker as a supporting frame, or even the exciter motor 150 itself.

The speaker 100 includes a damping material that is disposed internally within the speaker 100 within the hollow interior of the outer frame 110 between the DML surface 120 and the passive diaphragm 140. The damping material can be formed of any number of suitable materials (e.g., fiberglass or fibrous material made from polyester and/or cotton) and acts as a filler material and can take any number of different forms, including a panel of material.

In the present speaker 100, the rear emission is not directly radiated. As mentioned, the rear diaphragm 140 comprises an elastic membrane much like the head of a banjo. Unlike the DML surface 130, the passive diaphragm 140 cannot be effectively driven by motor 150, instead, the passive diaphragm 140 is driven by the mass of air within the sealed air cavity 190 (hollow interior of outer frame 110) behind the actively driven front plate (DML surface 130). The passive diaphragm (membrane) 140 is the outermost surface of the rear of the speaker 100 and the largest waves are stretching rather than bending. The behavior of the elastic membrane (passive diaphragm 140) differs fundamentally from that the rigid plate (DML surface 130) that is located in the front of the speaker. The mass of the air in the enclosure (air cavity 190) plus the elasticity of the passive diaphragm 140 acts as a band pass filter which results in a time delay between the front and the rear.

Although the rear diaphragm 140 may also exhibit modes they are concentric and resemble those of a drumhead and the pattern of radiation does not correlate with that of the DML surface (plate) 130. Thus, the cancellation typical of dipole loudspeakers, where present, is reduced and randomly distributed throughout the spectrum and not inversely related to frequency. In addition, the response of the rear diaphragm 140 can be tuned with changes to the mass, tension and elasticity of the diaphragm material. In the present speaker 100 the diaphragm may be tuned to emphasize frequencies which would otherwise be reduced in a DML of these dimensions.

Thus, the DML surface 130 and the passive diaphragm 140 are coupled to one another by means of the air in the cavity 190 (i.e., by means of the contained air). The spacing between the DML surface 130 and the passive diaphragm 140 is selected so that the speaker 100 operates in the manner described herein and more particularly, this distance is selected so as to allow the DML source 130 and the passive diaphragm 140 to be passively coupled by the air in the cavity 190. In other words, as mentioned herein, unlike the DML surface 130, the passive diaphragm is not actively excited by a device, such as the electro-acoustic exciter that operates on the DML surface 130.

Thus, in the present disclosure, the passive diaphragm 140 is a low-loss resonator intended to implement a radiant pattern as much as to influence frequency response. In contrast, in passive radiator implementations the passive part has a well-defined resonance at a particular frequency which is used to tune a loudspeaker driver/cabinet combination for optimal low frequency performance. The tuning is accomplished in the same way that vented loudspeakers are tuned. The effect of the passive radiator is only available in the part of the sound spectrum where the speaker is omnidirectional due to the small size of the cabinet in comparison to the wavelength of the sound. In the present speaker 100, the passive diaphragm 140 resonates at frequencies throughout the audio range, functioning as a system with the air contained (cavity 190) within speaker 100, to radiate sound rearward to implement the modified bipole/dipole pattern which gives the speaker 100 its unique presentation, as well as to modify the frequency response.

It will be appreciated that the speaker 100 is typically distributed as a pair of speakers 100. One speaker 100 represents the powered speaker 100 in that the speaker includes electronics and is connected to a power source as by passing through the outer frame. The electronics (not shown) are disposed within the hollow cavity of the outer frame 110 and in particular, can be attached to the outer frame 110 (e.g., along an inner edge thereof). The electronics include a printed circuit board (PCB) which comprises the amplifier of the speaker among other things and is mounted to the outer frame 110.

Both speakers 100 have at least one motor 150, preferably a pair of motors 150.

An audio cable (not shown) is used to connect the two speakers 100 to one another and permits the sound signal to be delivered from the powered speaker 100 to the non-powered speaker 100 that contains no electronics. The audio cable is typically connected to a jack that is provided as part of the speaker 100.

Streaming Platform

In accordance with the present invention, the speaker 100 is configured to be part of a streaming platform. The audio streaming platform is structured as one-to-many broadcast architecture. Mobile, browser and server-side applications allow for one-way publishing of 24-bit audio streams for real-time playback by software that runs on the hardware of the speaker 100. In any particular moment, a single source (mobile app or dedicated broadcast device) can broadcast an audio stream to a channel of the speaker 100. All speakers 100 that are online and subscribed to that particular channel will receive the audio stream (via intermediary broadcast server) simultaneously and in real-time.

As discussed herein, the speaker 100 is part of a connected speaker system and the software and streaming service can be provided and configured such that when a user turns on the speaker 100, the server knows that the speaker 100 is connected and the identity of the user is identifiable. Once connected, the present system is intended to provide the live transmission of sound. The present system provides a platform of live sound and in particular, in one embodiment, a connected music service is provided and the speaker 100 can be maintained constantly in an on position. When maintained in the on position, the broadcast is delivered to the user when the broadcast is ready for transmission. For example, when a musician launches a live transmission, the live broadcast is automatically delivered to the user.

Speaker Advantages

As discussed herein, the speaker of the present invention provides a number of advantages relative to a traditional DML as discussed herein. In particular, unlike traditional DML devices, the present invention includes the combination of a DML panel with a resonant passive (rear) diaphragm. The passive diaphragm resonates with all frequencies and therefore, it captures lower frequencies. As discussed herein, the front DML panel vibrates and causes displacement of air that is contained in the sealed cavity. The displaced air travels rearward and contacts the passive diaphragm resulting in movement of the passive diaphragm. However, there is no fixed relationship between the sound emitted from the front (DML member) of the speaker and the rear (passive diaphragm) of the speaker.

The foregoing description of the specific embodiments will so fully reveal the general nature of the invention that others can, by applying knowledge within the skill of the art (including the contents of the references cited herein), readily modify and/or adapt for various applications such specific embodiments, without undue experimentation, without departing from the general concept of the present disclosure. Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance presented herein, in combination with the knowledge of one of ordinary skill in the art.

What is claimed is:

1. A speaker comprising:

an outer frame defining a hollow interior space;

a distributed mode loudspeaker (DML) member disposed along a front face of the outer frame;

an elastic seal that is disposed around a perimeter of the DML member and being disposed between and coupled to the DML member and the outer frame, wherein elasticity of the elastic seal permits the DML member to move;

a passive diaphragm disposed along a rear face of the outer frame such that an air cavity is formed between the DML member and the passive diaphragm; and an electro-acoustic exciter for exciting resonant modes in the DML member;

wherein the DML member is coupled to the passive diaphragm by air contained within the air cavity.

2. The speaker of claim 1, wherein the outer frame is formed of wood.

3. The speaker of claim 1, wherein the DML member comprises a rigid plate.

4. The speaker of claim 3, wherein the rigid plate is formed of wood.

5. The speaker of claim 1, wherein the passive diaphragm comprises an elastic membrane that is coupled to a diaphragm frame that is coupled to the outer frame.

6. The speaker of claim 5, wherein the elastic membrane comprises an elastic film or elastic fabric that is stretched over the diaphragm frame.

7. The speaker of claim 1, wherein the air cavity comprises an air sealed cavity.

8. The speaker of claim 1, wherein the electro-acoustic exciter comprises an electro dynamic motor that is configured to excite the resonant modes in the DML member.

9. The speaker of claim 8, wherein there are at least two electro dynamic motors coupled to an inner surface of the DML member.

10. The speaker of claim 1, wherein the elastic seal comprises a bead of elastic material that is glued to the perimeter of the DML member and glued to the outer frame so as to suspend the DML member relative to the outer frame such that the DML member is free of direct contact with the outer frame.

11. The speaker of claim 1, wherein the elastic seal comprises a highly compliant rolled surround.

12. The speaker of claim 1, wherein the electro-acoustic exciter excites bending waves in the DML member.

13. The speaker of claim 1, wherein the passive diaphragm resonates at frequencies throughout an audio range and functions with air contained within the air cavity to radiate sound rearward and function as bipole radiator in a first segment of the audio range and function as dipole radiator in a different second segment of the audio range.

14. The speaker of claim 1, wherein there is no fixed phase relationship between sound emitted from the DML member and sound emitted from the passive diaphragm.

15. The speaker of claim 1, wherein the passive diaphragm comprises a membrane that is stretched onto a diaphragm frame that is coupled to the outer frame.

16. The speaker of claim 1, wherein the air cavity comprises an air sealed cavity.

17. A speaker comprising:

an outer frame defining a hollow interior space;

a distributed mode loudspeaker (DML) member disposed along a front face of the outer frame, the DML member being a plate;

an elastic seal that is disposed around a perimeter of the DML member and being disposed between and coupled to the DML member and the outer frame, wherein elasticity of the elastic seal permits the DML member to vibrate, wherein the DML member is free of direct contact with the outer frame;

a passive diaphragm disposed along a rear face of the outer frame such that an air cavity is formed between the DML member and the passive diaphragm, the passive diaphragm comprising an elastic fabric that is disposed along the rear face of the outer frame; and an electro-acoustic exciter that is coupled to and in contact with an inner face of the DML member for exciting resonant modes in the DML member;

wherein air contained within the air cavity serves to couple the DML member to the passive diaphragm such that air movement within the air cavity in response to vibration of the DML member is translated into movement of the passive diaphragm resulting in sound generation at both a front and a rear of the speaker.

* * * * *